United States Patent [19]

Moser

[11] 4,175,672

[45] Nov. 27, 1979

[54] CLOSURE ASSEMBLY

[76] Inventor: Henry T. Moser, 1451 Cattleman Rd., Sarasota, Fla. 33577

[21] Appl. No.: 961,956

[22] Filed: Nov. 20, 1978

[51] Int. Cl.[2] ..... B65D 43/14; B65D 51/04

[52] U.S. Cl. ..... 220/334; 220/20; 312/292

[58] Field of Search ..... 220/334, 20, 210, 337, 220/342, 343; 312/216–219, 291, 292; 232/24

[56] References Cited

U.S. PATENT DOCUMENTS

| | | | |
|---|---|---|---|
| 1,612,335 | 12/1926 | Wilhelm | 232/24 |
| 2,803,512 | 8/1957 | Band | 312/292 X |
| 3,936,108 | 2/1976 | Chitester | 312/217 |
| 4,033,476 | 7/1977 | Greenquist | 220/334 |

*Primary Examiner*—George T. Hall

*Attorney, Agent, or Firm*—John Orman; Arthur W. Fisher, III

[57] ABSTRACT

A container structure generally in the form of a housing having at least one but preferably a plurality of compartments defining a primary compartment area and having movably attached thereto a plurality of closure elements disposed to regulate access to the interior of the compartments. A pivotal locking element has an elongated configuration and an outwardly extending tongue disposed for pivotal, locking engagement with a similarly dimensioned elongated groove formed on each of the closure elements to provide locking engagement therewith. A hinge structure is secured to allow pivotal movement of the one or more compartments out of the interior of the housing so as to provide access through the open top of the compartment independent of the cover elements. The disposition and specific structural configuration of the locking element relative to the structure of the closure element and predetermined portions of the housing prevent sufficient sealing and/or isolation of the interior of the compartment thereby reducing or eliminating seepage into the interior.

17 Claims, 7 Drawing Figures

FIG. 1
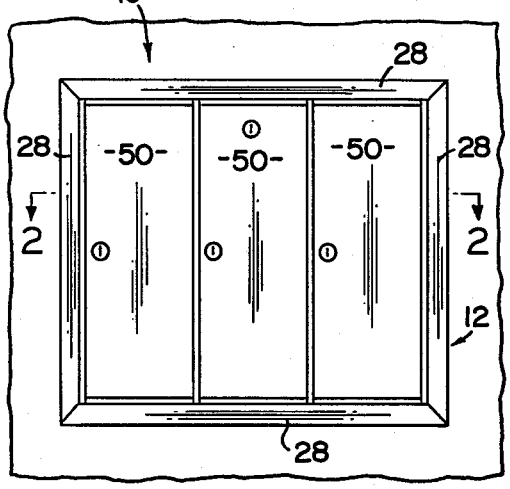
FIG. 4
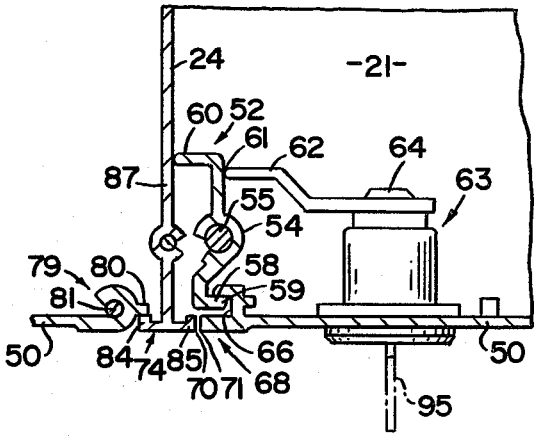
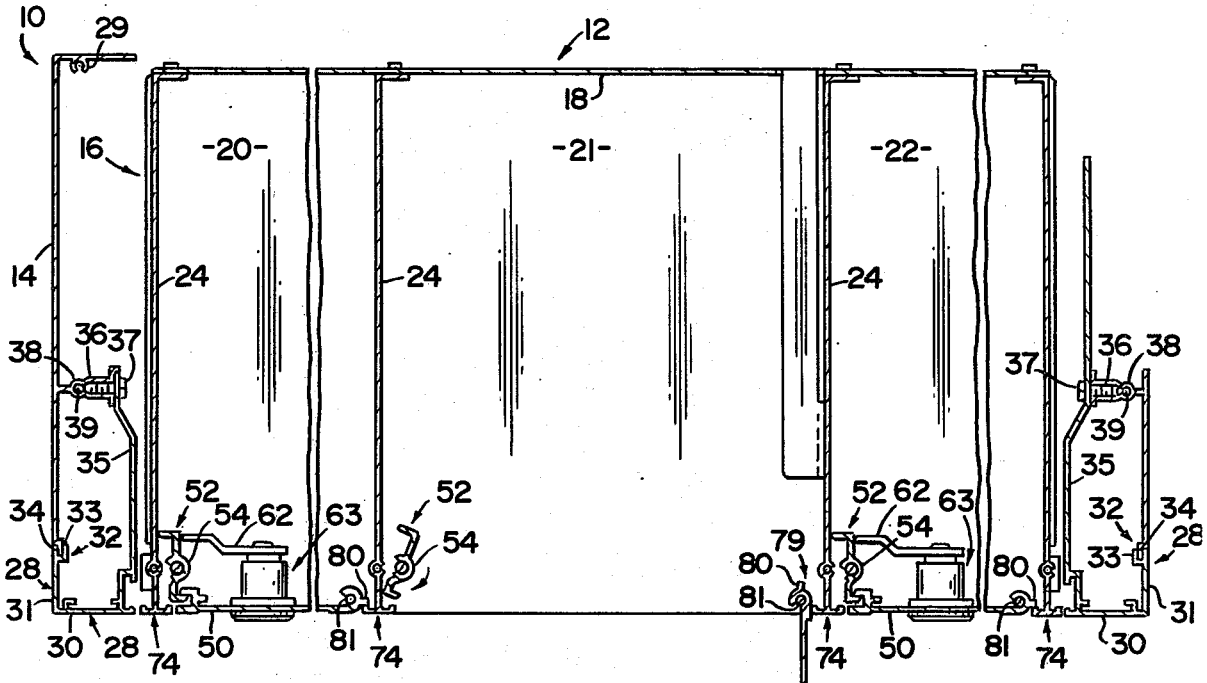
FIG. 2
FIG. 5
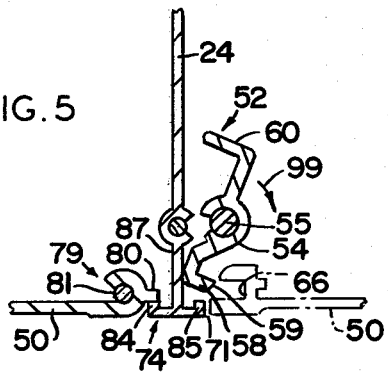

CLOSURE ASSEMBLY

BACKGROUND OF THE INVENTION

1. Field of the Invention

A container and/or cabinet structure defining on the interior thereof one or more compartments isolated from the exterior through structural configuration and disposition of the locking element disposed along the junction of one or more closure elements and a correspondingly positioned portion of the housing herein the closure elements are pivotal to an open relation to provide access to the interior of the various compartments.

2. Description of the Prior Art

There are numerous container and/or cabinet structures existing in the prior art and commercially available to the general public. Such cabinet or container structures are normally designed to accomplish or be utilized in a particular application. Common application is the formation of a container or cabinet structure for use as mail deposit boxes. When such structures are installed in multi-unit dwelling buildings such as apartment houses, etc. the subject cabinet structure comprises a plurality of individual compartments each having a closure element or door which allows access to the interior of the compartment by the individual tenant assigned to that compartment. In addition access to all of the multi compartments are provided for the delivery of mail to each of the individual compartments. Such access is usually accomplished by at least partial removal of entire sections of the container or cabinet structure from a supporting frame or housing thereof. This eliminates the necessity of the postal employee to open each of the individual closure elements for the purpose of depositing mail or any like articles therein. Accordingly, cabinet or container structures utilized for mail deposit and delivery generally are characterized by an overally complex structural configuration which in turn adds to the initial expense in purchasing such a unit as well as the overall expense or cost associated with the maintenance of such a unit.

In addition such multi compartment structures are frequently exposed directly to the elements due to their location out of doors or in some area reachable by rain, wind, etc. While each of the various closure elements associated with the conventional mail deposit facilities normally have some type of lock arrangement to prevent inadvertent or unauthorized opening of a given compartment. These lock elements are primarily designed to prevent such unauthorized opening of the individual doors or closure elements. A vast majority of such locking facilities do not accomplish any effective sealing or isolation of the interior of the compartments from the exterior thereof, so as to prevent seepage or leakage of water or like elements into the interior of the compartment. Similarly, it is quite common for leakage of rain water, snow or like precipitation to enter the seams or junctions surrounding the closure element thereby damaging or ruining the contents of the individual compartments.

It should be noted that while the aforementioned discussion has been primarily directed to the structure of prior art or commercially available mail deposit cabinets or containers, it is herein acknowledged that cabinet and container structures exist in the prior art having a wide variety of structural designs. However, such existing cabinet structures also suffer from the inherent problems mentioned above and generally do not provide proper protection of the contents of such compartments when exposed to the environment unless the structure of the individual cabinet or container facilities is extremely complex. Again, as mentioned above, such sophisticated structural design is often prohibitably expensive thereby eliminating the use of these more sophisticated cabinet structures in many applications.

Attempts have been made in the prior art to overcome some of the aforementioned problems and such structural attemps are evidenced at least in part of the structures disclosed in the following U.S. patents: U.S. Pat. No. 3,893,740 to England discloses a locking device having a pivoted external panel locked by a key in the conventional manner utilizing a bracket and lock assembly and associated lever element. U.S. Pat. No. 3,851,941 to Steebe shows an elongated locking member which is pivotally mounted and spring biased to engage a tongue and groove type attachment. The patent to Courson, U.S. Pat. No. 3,287,079 shows a hinge structure for an outwardly pivoting door element so as to provide access to the interior of the outwardly pivoted structure. In addition the following U.S. patents show various structural configurations of prior art cabinet or container structures: U.S. Pat. Nos. 1,013,444; 2,835,547; 3,172,713; 3,175,873; 3,238,003; 3,602,564; 3,744,864; 3,790,244; 3,936,108; and 4,092,056.

While each of the structures set forth in the aforementioned patents are specifically designed to accomplish or be utilized in a specific application, it is evident that structures of this type frequently suffer from the problems set forth above.

Accordingly there is a need in the related industry for a container or cabinet structure having one or a plurality of compartments with connected and associated closure element wherein sufficient locking facilities are provided which also act as a barrier or seal facility to prevent access to the interior of the compartments. Such a preferred and intended cabinet structure could be designed to be used as a mail deposit and collection facility or alternately could be designed for numerous other uses not specifically limited to the deposit and/or collection of mail.

SUMMARY OF THE INVENTION

This invention relates to a container structure or cabinet structure specifically designed to have one or more individual compartments mounted on the interior of a housing means. Each of the compartments has connected thereto a closure element in the form of a pivotally mounted door or like structure. This closure element and the associated compartment defines or may be termed a compartment means. A compartment means is positioned on the interior of a frame which is part of the overall housing means. The frame itself preferrably comprises a surface mount adaptor means which is structured and configured for securement to any type of supporting surface. The frame further includes a recess frame portion mounted on the interior and attached to a leading edge of the surface mount adaptor means through adaquate extending flanges and a tongue and groove engagement. A compartment means in turn is movably or pivotally mounted to the recess frame due to the provision of a hinge means.

The hinge means comprises an elongated rib element extending along the length of or located at predetermined portions on one substantially upper most leading, corner of the recess frame. The hinge means further comprises an elongated groove element dimensioned and configured to surround the outwardly projecting rib so as to allow pivotal motion of the attached compartment means relative to the rib and accordingly to the remainder of the frame. The elongated groove element is attached to a bottom corner portion of the compartment means substantially adjacent or contiguous to the outer surface or face portion of the compartment means. The existence and disposition of this hinge means allows the outward pivotal motion of the compartment means so as to provide access through an open top of the compartment means to the interior thereof independent of the opening of the individual closure elements associated with each of the aforementioned individual compartments.

An important structural feature of the present invention comprises the existing of a pivotal locking means pivotally mounted on the interior of the individual compartments of the compartment means and immediately adjacent to the junction between a leading edge of each closure element and a predetermined correspondingly positioned portion of the housing means. The pivotal locking means comprises an elongated configuration and outwardly extending flange having a tongue element defined by the leading edge of such flange. Pivotal movement of the tongue element and associated flange is provided so as to dispose the tongue element into locking engagement with an integrally formed groove essentially formed along the leading edge of the closure element. By virtue of this connection the flange of the locking means serves as an effective barrier between the junction of the leading edge of the closure element and a predetermined associated portion of the housing means and the interior of the individual compartment. This barrier serves to prevent leakage or seepage of water or any like elements to the interior of the compartment. Movement of the pivotal locking means into its closed position relative to the closure element is accomplished by a key or like element operated lock having a rotably mounted tail piece mounted thereon. When the closure element is disposed in its closed position rotation of the tail piece through manipulation of a proper key will cause pivotal movement of the locking means through engagement with the tail piece thereby forcing the tongue element into locking engagement on the interior of the elongated groove thereby serving to establish both a sufficient locking facility to prevent opening of the closure element and also the aforementioned barrier. A seal flange is also integrally formed on the trailing longitudinal edge of the closure element and is disposed to extend outwardly therefrom into substantially sealing engagement with another predetermined portion of the housing means. The seal flange and its engagement with the noted portion of the housing means prevents seepage of water or like elements through that particular junction of that particular portion of the closure element and associated portion of the housing. Accordingly, the subject invention comprises a cabinet or container structure having a efficient locking facility which serves not only to insure locked closure of a given closure element relative to an interior compartment portion but also serves to act as a barrier along the junction of the opening or leading edges of the closure element relative to a predetermined portion of the housing so as to prevent leakage of unwanted elements such as water, etc. to the interior of the compartment.

In addition, the subject cabinet structure is effectively structured to allow outward pivotal extension or motion of the entire compartment means so as to provide common access to all of the plurality of compartment or alternately to the overall compartment area defining the compartment means through the provision of a hinge element disposed in interconnecting relation between a recess frame portion of the overall frame and the pivotal corner of the compartment means itself.

It should be emphasized at this point that the subject container or cabinet structure, while herein described with specific reference to application for use as a mail deposit or collection facility is not limited to such use. To the contrary the various structural components which are the subject matter of the present invention are designed for utilization in any type of container or cabinet structure irrespective of the uses or specific applications for which the overall cabinet structure is intended.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a front cutaway view showing the face or outer surface portion of a plurality of closure elements mounted on a housing on the subject container or cabinet structure.

FIG. 2 is a sectional view showing the interior of the subject cabinet or container structure taken along line 2—2 of FIG. 1.

FIG. 4 is a detailed view in section and partial cutaway showing the locking means and seal means of the present invention.

FIG. 5 is a detailed view in section and partial cutaway showing the structural embodiment of FIG. 4 in its open position in comparison with the closed position disclosed in FIG. 4.

Similar reference characters refer to similar parts throughout the several views of the drawings.

DETAILED DESCRIPTION OF THE PREFERRED EMBODIMENT

Figure 3:
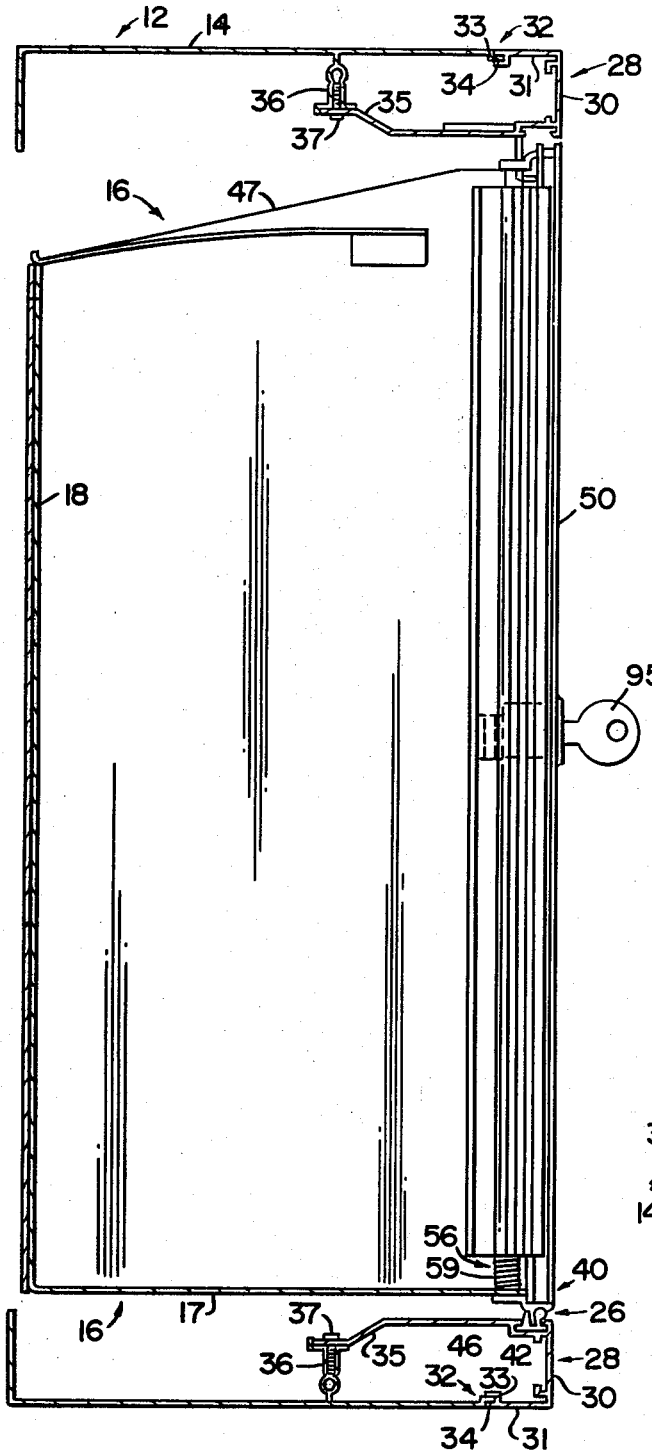
FIG. 3 is a sectional end view showing the interior of the housing of the embodiment of the invention shown in FIGS. 1 and 2.

As best shown in FIGS. 1, 2, and 3 the subject invention relates to a container structure generally indicated as 10 comprising a housing means generally indicated as 12 having frame means defining a majority thereof. The frame means includes a surface mount adapter means 14 disposed in substantially enclosing relation to a compartment means 16. The compartment means includes a bottom panel 17 and a rear or back panel wall 18 (FIG. 3). In addition a compartment means may be divided into a plurality of individual compartments 20, 21 and 22 wherein the individual compartments are separated by partition means defined by a plurality of partition elements 24.

As will be explained in greater detail hereinafter the compartment means 16 is pivotally mounted, through provisions of hinge means generally indicated as 26 (FIG. 3 and 8) on the interior of the housing means 12. A recess frame portion 28 is disposed in interconnecting relation between the compartment means 16 and the surface mount adaptor means 14. More specifically the recess frame portion is interconnected to support and have movably mounted thereto the compartment means about the hinge means 26.

The primary purpose of the surface mount adaptor means 14 is to secure the entire housing of the subject container structure to a given supporting surface as best shown in FIG. 1. The surface mount adaptor means 14 may be secured to any type of supporting surface depending upon particular application to which the intended structure is designed to be used. Adapter connector elements 29 secure mating portions of top side and rear portions together. However, the surface mount adaptor means 14 can be secured to a given supporting surface or structure in any applicable means as long as the entire housing structure is adequately supported.

Figure 7:
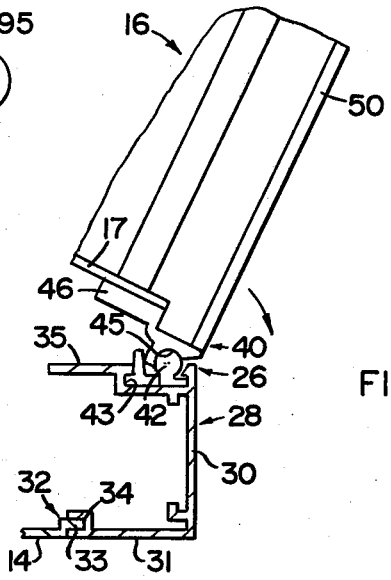
FIG. 7 is a detailed view and a partial section and cutaway showing structural details of the hinge means of the present invention.

The recess frame portion 28 comprises a facing surface 30 integrally connected to a connecting wall 31. The leading peripheral edge as at 32 of the recess frame portion 30 has a groove element 33 integrally formed thereon. This groove element serves to engage in locking connection a correspondingly positioned leading edge 34 of the surface mount adaptor means 14 as best shown in FIGS. 2 and 3. This interengagement causes secure connection and effective sealing engagement between the surface mount adaptor means 14 and the recess frame portion 28. Further securement occurs through the extending wall member 35 being disposed in engageable relation with channel means 36. A conventional connector 37 passes through the wall member 35 into the channel means 36 to accomplish effective interconnection between these two elements. Similarly an adaptor channel 38 is positioned to receive a proper connector 29 also to accomplish secure engagement between the surface mount adaptor 14 and the recess frame portion 28. With reference to FIG. 7 the compartment means 16 is movably supported by the recess frame portion 28 immediately adjacent to its bottom leading corner portion generally indicated as 40. To accomplish adequate pivotal motion between the compartment means 16 and the recess frame portion 28 the hinge means 26 is provided in interconnecting relation therebetween. More specifically the hinge means 26 comprises an elongated rib element 42 attached in strip form within recess 43 of the recess frame portion 28 along side wall 35. The rib 42 may be disposed at periodic location along the entire lower transverse edge of the compartment means or alternately may extend along the entire length thereof to provide proper pivotal motion along the corner portion 40 of the compartment means 16. The hinge means 26 further include an elongated groove having a sufficient dimension configuration to at least partially encompass and pivotally ride on the rib 42. The elongated groove 45 also may be attached by conventional means and/or integrally formed to a contiguous relation to the corner 40 as best shown in FIG. 8. Structural support of the groove as at 46 may be attached in the aforementioned manner so as to provide proper strength to the hinge element in allowing continuous pivotal motion through numerous operations or openings of the compartment means. This pivotal motion of the corner 40 about the recess frame portion 28 due to the existence and location of hinge means 26 allows the outward extension of the compartment means so as to provide access to the plurality of compartment 20, 21, 22, etc. through an open top portion 47 of the compartment means. This open top, as set forth above allows access to the interior of the compartment means independent of the closure means comprising 1 or more individual closure elements 50 (FIG. 1 and 2).

With primary reference to FIGS. 2, 4, and 5, an important structural feature of the present invention comprises a locking means generally indicated as 52. As shown in FIG. 2 each of the closure element 50 comprising the closure means is associated with the locking means 52. Accordingly for purposes of clarification a single locking means will be described. However, the structural elements of all the locking means 52 are substantially equivalent under operation with cooperation with the closure elements 50 operate in the same manner to accomplish the same purpose.

Figure 6:
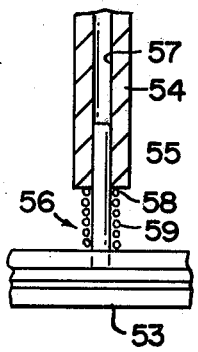
FIG. 6 is a detailed view in partial cutaway and section showing the pivotal connection of the locking means of the present invention.

Each of the locking means 52 comprises a pivotal locking element rotatably or pivotally mounted to the housing means on the interior of the individual compartments as best shown in FIG. 6. The sill 53 represents the frame of the closure element 50 wherein a pivot pin 55 is secured to the sill 53 and thereby to the overall housing means 12. The pin 55 is specifically dimensioned and structured to fit on the interior of a channel 57 which is centrally located relative to the pivot locking element 54. FIG. 6 represents one end only of the locking element 54 being pivotally attached to the frame. However, the opposite end is also attached in a similar manner utilizing the pivot pin 55 about which the locking element 54 pivots or rotates. A biasing means generally indicated as 56 is disposed about the pivot pin 55 and in attachment as at 58 to the locking element 54. This biasing means 56 may be in the form of a conventional coil type spring 59 interconnected to the locking element 54 so as to normally bias it in its open position out of engagement with the closure element 50 as best shown in FIG. 5.

Further structural features of the locking means 52 comprises flange means in the form of a first outwardly extending flange 58 defining a tongue element 59 along the leading edge thereof. The flange means of the locking means 52 further comprises a second flange 60 disposed opposite the first flange 58 relative to the pivot pin 55 and extending an opposite direction as shown in FIGS. 4 and 5. Accordingly the disposition of the first and second flange essentially defines a Z cross sectional configuration of the locking means 52 as easily seen in FIGS. 4 and 5. The second flange 60 is brought into a butting relation with the correspondingly positioned surface of the partition element 24 upon it being forced into its locking or closed position (FIG. 4) with the closure element 50. This forced movement of the locking element 54 is accomplished through movable forced engagement with tail piece 62 of activating means generally indicated as 63. More specifically the tail piece 62 is rotatably or pivotally mounted about a pivot facility 64 into sliding engaging relation with the locking element 54 as at 61. This engagement forces pivotal movement of the locking element 54 against the biasing force of spring 59 until the locking element 54 reaches its closed or locked position. This closed or locked position is defined by the closure element 50 being in its closed access position relative to compartment means 21. More specifically each of the closure elements 50 has formed thereon an elongated groove element or means 66 defined along and integrally connected to the leading edge of each of the closure elements 50 generally indicated as 68. Such leading edge 68 is positionable in its closed relation so as to define a junction between the closure element 50 and a predetermined portion of the partition element 24 as at 70. Each of the closure elements 50 also has a trailing longitudinal edge generally indicated (FIG. 2) as 79 which will be explained in greater detail hereinafter. The tongue element 59 of the lcok element 54 is specifically disposed, dimensioned, and configured to engage into the interior of the groove 66 whereby establishing a locking interengagement between the leading edge 68 of closure element 50 and the tongue element 59 of the lock element 54.

It is also an important structural feature of the present invention to note that the elongated first flange 58 is specifically disposed between the interior of a given compartment 21 and the junction as at 70 defined between the leading portion 60 of closure element 50 and the facing portion 70 of the individual partition element 24. In order to apply proper opening and closing of the closure element 50 a seam or space has to occur at this junction. Therefore it is evident that seepage of water or like elements can easily occur through such space. The space referred to indicated in FIGS. 4 and 5 as 71 is effectively isolated by the disposition of the first flange 58 and the accompanying tongue element 59 into the elongated groove 66. Accordingly the interior of a given compartment 21 is effectively sealed by the provision of this barrier means when the closure element 50 is in its closed and locked position through engagement with the first flange and associated tongue element 58 and 59 respectively relative to elongated groove 66 on the leading edge 68 of the closure element 50.

Additional seal means are provided on the closure element 50 through the provision of a sealing flange 80 defined along the trailing longitudinal edge 79 the closure 50. More specifically the sealing flange 80 is substantially off set relative to the remainder of the closure element or door 50 and is disposed on the opposite side of the pivot axis defined by a pivot pin 81. In such position the pivotal movement of the door 50 causes similar pivotal movement of the sealing flange 80 about the pivot axis as at 81. Such sealing flange is disposed to sealingly engage an outwardly extending flange element 84 as best shown in FIG. 5. Such sealing engagement occurs when the closure element 50 is its closed or locked position. The accomplishment of such sealing engagement occurs through the specific provision of providing the flange facing portion 74 to have oppositely and outwardly extending facing flanges 84 and 85 extending in substantially perpendicular relation to the main partition wall 87. The disposition of such facing flanges 84 and 85 first allows for the sealing engagement of the trailing edge 79 of closure element 50 with facing flange 84 and sealing flange 80 as well as the establishment of the junction between the leading edge 68 of closure elment 50 and the corresponding facing flange 85. Space 71 is defined between facing flange 85 and the leading edge 68 and is effectively isolated from the interior of a given compartment 21 through the provision of the first flange 58 being disposed in its closed position (FIG. 4).

In operation a key element or like turning tab 95 (FIG. 4) is inserted in the activating means 63 which may be a lock or like facility. Turning of the key 95 causes rotation of the tail piece 62 into engagement or out of engagement with the locking element 54 thereby causing movement of the second flange 60 towards the wall of the partition 24. In FIG. 4 the tail piece 62 is rotated to force the locking element 54 into its closed position against the biasing force of spring element 59. In FIG. 5 the tail piece has been rotated out of engagement with the locking element 54 allowing its rotation or pivotal movement, as indicated by directional 99 out of locking engagement with the groove 66 of closure element 50.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A container structure of the type including a movably mounted closure means providing and preventing access to the interior of such container structure, said container structure comprising housing means, said closure means comprising at least one closure element pivotally mounted to said housing means and disposable to removably block access to the interior of at least a portion of said housing means, locking means pivotally mounted on said housing and disposed into locking engagement relative to a predetermined portion of said closure element, said locking means comprising a substantially elongated configuration extending along at least a major portion of the length of said predetermined portion of said closure element and disposed to at least partially define barrier means disposed between the interior of said housing and a junction between said closure means and a substantially correspondingly positioned portion of said housing means.

2. The container structure as in claim 1 wherein said closure element comprises a groove means having an elongated configuration and disposed to extend along and at least partially define a predetermined portion of said closure element; said locking means including a tongue element extending outwardly from a remaining portion of said locking means, said tongue element movably disposed into and out of engagement with said groove means, said tongue element and said groove means relatively disposed to entry of the former into the latter, whereby said closure element is prevented from opening and providing access to said container structure upon the establishment of said locking engagement.

3. A container structure as in claim 2 wherein said tongue element is integrally formed on a flange means so as to at least partially define a leading longitudinal edge portion thereof, said flange means disposed to extend outwardly from a remaining portion of said locking means so as to at least partially define said barrier means, said flange means comprising a longitudinal dimension substantially equivalent to the length of said junction and disposed substantially adjacent thereto, whereby said barrier means substantially isolates the correspondingly positioned interior portion of said housing means from the exterior thereof and limits seepage therein.

4. A container structure as in claim 1 further comprising biasing means attached to said locking means and disposed to normally bias said locking means out of engagement with said closure element in an open position; activating means mounted on said one closure element and including a tailpiece movably connected to said closure element and disposed to extend substantially outwardly therefrom into movable engagement with said locking means, said tailpiece positionable to dispose said locking means into engagement with said closure element and against said biasing force thereby defining a locked position of said one closure element.

5. A container structure as in claim 3 wherein said flange means of said locking means comprises a first flange element having said tongue element formed thereon and extending outwardly from a remaining portion of said locking means and into engageable relation with said groove means, said flange means comprising a second flange element extending outwardly from a remaining portion of said locking means in a direction substantially opposite to the extending direction of said first flange element, said second flange element disposable towards an interior portion of said housing means, under influence from said biasing means, said first and second flange elements disposed on opposite sides of an axis of rotation of said pivotally connected locking means so as to define a substantially Z-shaped sectional configuration.

6. A container structure as in claim 1 wherein said housing means comprises partition means disposed at least in part on the interior thereof and positioned to segregate predetermined portions of the interior of the housing means from one another, said partition means comprising a facing portion disposed substantially contiguous the front surface of said housing and adjacent to a leading edge of said one closure element so as to at least partially define said housing portion of said junction.

7. A container structure as in claim 6 wherein said partition means comprises a plurality of partition elements, each of said partition elements including a facing portion and each disposed substantially contiguous the front surface of said housing means, a facing portion of one of said partitions elements disposed adjacent to a leading edge of said one closure element so as to at least partially define housing portion of said junction, said facing portion of a second of said plurality of partition elements disposed substantially adjacent relative to a trailing longitudinal edge portion of said closure element and engageable therewith to define a seal means structured to isolate the interior portions of said housing means from the exterior thereof.

8. A container structure as in claim 7 wherein said one closure element is pivotally connected to said housing means along a longitudinal pivot axis, a sealing flange mounted on said closure element and disposed to extend outwardly from said pivot axis, said trailing longitudinal edge portion integrally formed on said seal flange and pivotal upon pivotal movement of said closure element into and out of sealing engagement with said facing portion of said second partition element.

9. A container structure as in claim 8 wherein said closure means comprises a plurality of closure elements pivotally mounted on said housing in spaced apart relation to one another, each of said plurality of partition elements comprising said facing protion disposed adjacent and in separating relation to adjacently position of said closure elements, each of said facing portions configured to include at least a first facing flange extending outwardly from a main partition wall into spaced, adjacent relation with a leading edge of one adjacently positioned closure element, said facing portion including a second facing flange extending outwardly from said main partition wall, and disposed for sealing engagement with said sealing flange of said next adjacent closure element.

10. A container structure as in claim 9 wherein said first and second sealing flanges are substantially coplaner and extended outwardly from said partition wall in substantially opposite directions, an outer surface of said coplaner first and second flanges defining a portion of said outer face of said housing means and said sectional configuration of each of said facing portions defining a T configuration.

11. A container structure as in claim 1 wherein said housing means comprises compartment means mounted on the interior of said housing means and connected to said closure means, said closure means pivotally disposed on said compartment means to regulate access to the interior thereof through movement thereon between an open and closed position, said housing means further comprising a frame means at least partially enclosing said compartment means in supporting relation thereto.

12. A container structure as in claim 11 wherein said frame means comprises surface mount adapter means disposable in connected relation to supporting surface being independent of said container structure, said compartment means movably mounted on the interior of said surface mount adaptor means and pivotal outwardly therefrom to provide access to the interior thereof independently of said closure means.

13. A container structure as in claim 12 wherein said frame means comprises a recess frame portion disposed in interconnected relation between said surface mount adapter means and said compartment means and in supporting relation to said compartment means.

14. A container structure as in claim 13 wherein a peripheral edge of one of said surface mount adapter means and said recess frame portion is disposed in mating engagement with an integrally formed groove defined along a leading edge of the other of said surface mount adapter means and said recess frame portion, said interconnection between said surface mount adapter means and said recess frame portion thereby defining a tongue and groove connection.

15. A container structure as in claim 13 wherein said recess frame portion comprises adapter channel means formed thereon and disposed in attached relation to said surface mount adapter means, said adapter channel means dimensioned and configured to receive connectors therein for fixed securement between said surface mount adapter and said recess frame portion.

16. A container structure as in claim 11 further comprising hinge means mounted on said frame means, said compartment means movably connected to said frame means by pivotal support of the engagement with said hinge means, said hinge means extending along a bottom leading corner portion of said compartment means substantially adjacent the outer surface thereof, said compartment having said corner portion disposed for pivotal movement about said hinge means, such that an open top portion of said compartment means extendable outwardly from the interior of said frame means to provide access to the interior of said compartment means independently of said closure means.

17. A container structure as in claim 16 wherein said hinge means comprises an elongated rib element connected to said frame means and extending along a predetermined length of said corner portion, said hinge means further comprising groove means including an elongated groove connected to said corner portion and extending along the length thereof in pivotal engagement with said rib element, whereby pivotal movement of said compartment means about said corner portion occurs relative to said rib.

* * * * *